US008801269B2

(12) United States Patent
Grossenbacher et al.

(10) Patent No.: US 8,801,269 B2
(45) Date of Patent: Aug. 12, 2014

(54) DISPLAY ON THE OSCILLATING WEIGHT OF A SELF-WINDING MOVEMENT

(71) Applicant: Blancpain S.A., Le Brassus (CH)

(72) Inventors: Bernhard Grossenbacher, Langenthal (CH); Nicolas Debaud, Puidoux (CH)

(73) Assignee: Blancpain S.A., Le Brassus (CH)

( * ) Notice: Subject to any disclaimer, the term of this patent is extended or adjusted under 35 U.S.C. 154(b) by 0 days.

(21) Appl. No.: 13/914,759

(22) Filed: Jun. 11, 2013

(65) Prior Publication Data

US 2013/0336096 A1 Dec. 19, 2013

(30) Foreign Application Priority Data

Jun. 14, 2012 (EP) ..... 12171999

(51) Int. Cl.
*G04B 5/02* (2006.01)

(52) U.S. Cl.
USPC ..... 368/148; 368/208; 368/212

(58) Field of Classification Search
USPC ..... 368/148, 208, 210, 212, 15, 18, 33, 184
See application file for complete search history.

(56) References Cited

U.S. PATENT DOCUMENTS 663,263 A * 12/1900 Elenius ..... 368/210
1,973,898 A * 9/1934 Henry ..... 368/148
2,774,252 A * 12/1956 Meyer ..... 475/329
5,828,628 A * 10/1998 Born et al. ..... 368/66
7,857,502 B2 * 12/2010 Rochat ..... 368/212
8,342,740 B2 * 1/2013 Beccia et al. ..... 368/208
2009/0129211 A1 5/2009 Rochat
2011/0205857 A1 8/2011 Beccia et al.

FOREIGN PATENT DOCUMENTS

EP 1 826 633 A1 8/2007
EP 2 360 535 A1 8/2011

OTHER PUBLICATIONS

European Search Report issued Nov. 30, 2012 in Europe 12171999.1, filed Jun. 14, 2012 (with English Translation).

* cited by examiner

*Primary Examiner* — Sean Kayes
(74) *Attorney, Agent, or Firm* — Oblon, Spivak, McClelland, Maier & Neustadt, L.L.P.

(57) ABSTRACT

Device (100) for displaying a magnitude on an oscillating weight (1) for a self-winding timepiece movement (10) comprising a means (20) of displaying said magnitude by comparison to a complementary display means (30).
Said display means (20) pivots coaxially to said oscillating weight (1), and is subject to a general pivoting motion resulting from the combination of a first pivoting motion synchronous with that of said oscillating weight (1), and a second pivoting motion resulting from said display means (20) being pivoted by said movement (10) relative to said complementary display means (30) integral with said oscillating weight (1).
Oscillating weight (1) including such a device (100).
Self-winding watch including an oscillating weight (1) comprising such a device (100), and whose motions are transmitted to a mainspring of said watch.

20 Claims, 4 Drawing Sheets

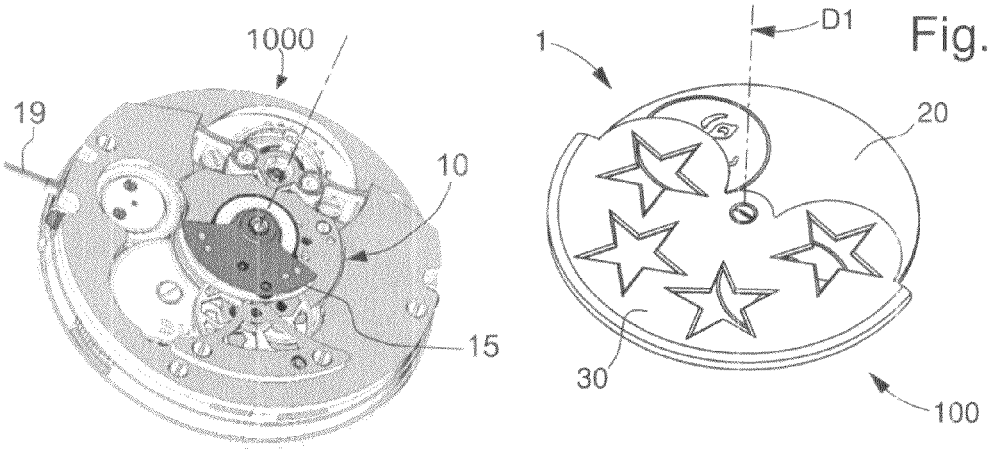
Fig. 15
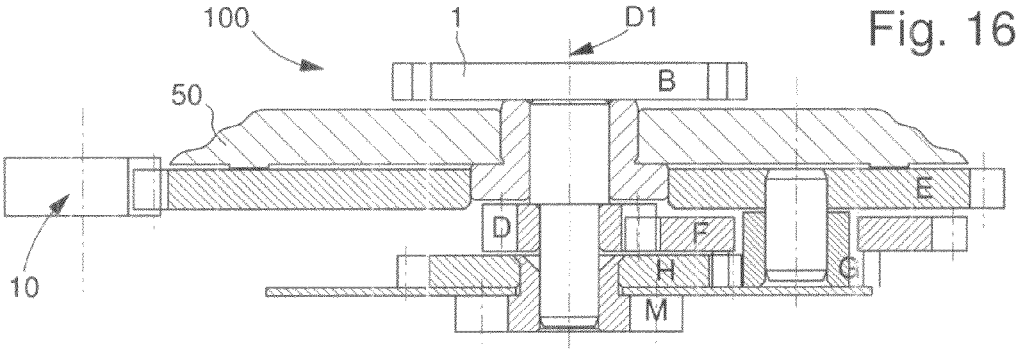
Fig. 16
Fig. 17
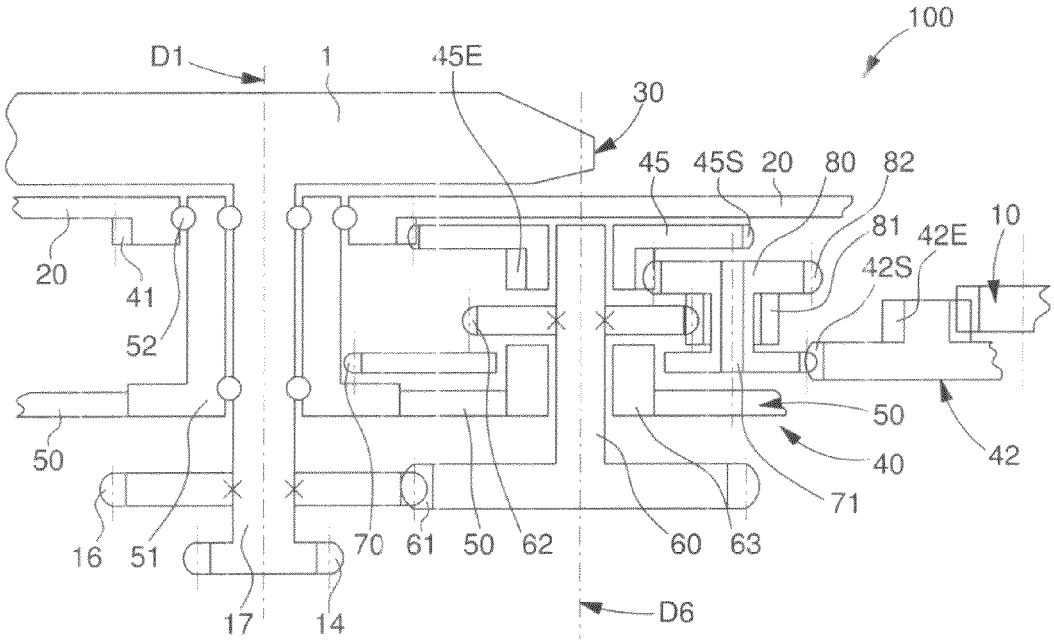

DISPLAY ON THE OSCILLATING WEIGHT OF A SELF-WINDING MOVEMENT

This application claims priority from European Patent Application No. 12171999.1 filed Jun. 14, 2012, the entire disclosure of which is incorporated herein by reference.

FIELD OF THE INVENTION

The present invention concerns a device for displaying at least one magnitude on an oscillating weight for a self-winding timepiece movement, said device comprising one said oscillating weight and a means of displaying said at least one magnitude by comparison to a complementary display means which is integral with said oscillating weight.

The invention further concerns a timepiece movement having a self-winding mechanism with at least one such oscillating weight, whose motions are transmitted to at least one mainspring comprised in the movement.

The invention also concerns a self-winding watch including a timepiece movement having a self-winding mechanism with at least one such oscillating weight.

The invention concerns the field of watchmaking, and more specifically the field of self-winding watches.

BACKGROUND OF THE INVENTION

In a self-winding watch, the wearer's movements are transmitted to the mainspring via an oscillating weight and a self-winding mechanism comprising a reduction gear.

The gear train of a self-winding mechanism is formed of toothed elements which transmit the force from the oscillating weight to the ratchet and enable the mainspring(s) to be wound. Upstream of the ratchet, this self-winding mechanism train usually includes, on the one hand, an intermediate train formed of an oscillating weight pinion and intermediate direction reverser wheel sets, and on the other hand, a reduction gear, arranged for reducing the initial velocity of the oscillating weight and increasing the force used for winding the mainspring.

Multiplying the complications in a mechanical watch leads, on the one hand, to complexity of the mechanisms of the movement, and on the other hand, to difficulty as regards the display, which is restricted by the available visible space on the front and possibly the back of the watch, or on additional surfaces such as the edges of the case or other surfaces. This problem is particularly acute when the watch is of small size, especially in the case of a ladies' or child's watch. Indeed, there is less available volume and the displays must remain legible, which requires maximising all the surfaces of the watch visible to the user.

The display of the power reserve on the oscillating weight is described in CH Patent No. 301 497, which discloses a self-winding watch including an oscillating weight whose motions are transmitted to a mainspring of the watch, said watch also including a power reserve indicator device including power reserve display means. There is also known from EP Patent No. 1 826 633 a self-winding watch including an oscillating weight whose motions are transmitted to a mainspring of the watch, said watch also including a power reserve indicator device comprising a power reserve display means, which is mounted on the oscillating weight. EP Patent Application No 2 360 535 A1 in the name of BLANCPAIN SA discloses a watch of this type, whose power reserve display and reference dial pivot synchronously at a given time.

SUMMARY OF THE INVENTION

The invention proposes to provide a solution to the problem of making a display mechanism for one or several functions, which is wholly or partially integrated in the oscillating weight, which is reliable, simple to implement and highly robust.

The present invention therefore concerns a device for displaying at least one magnitude on an oscillating weight for a self-winding timepiece movement, said device comprising a means of displaying said at least one magnitude by comparison to a complementary display means which is integral with said oscillating weight, characterized in that said display means pivots coaxially with said oscillating weight, in that said display means is subject to a general pivoting motion resulting from the combination of a first pivoting motion synchronous with that of said oscillating weight, and a second pivoting motion resulting from said display means being pivoted by said movement relative to said complementary display means.

According to one feature of the invention, in a first variant said display means is integrated in said oscillating weight.

According to another feature of the invention, said display means is integral with a crown of a differential gear whose reference pinion is driven by said movement.

According to a particular feature of the invention, said differential gear is a differential gear with two planetary wheels, a first planetary wheel of which is driven by said reference pinion and drives a second planetary wheel which in turn drives said crown.

According to a feature of the invention, in a particular variant, said differential gear is carried by said oscillating weight.

According to a feature of the invention, in another particular variant, said differential gear is housed in said movement and is external to said oscillating weight.

According to a feature of the invention, in another particular variant, said display means pivots about said oscillating weight via at least one ball bearing.

According to a feature of the invention, in a second variant of the invention, said display means pivots coaxially to said oscillating weight and independently therefrom.

The invention also concerns a timepiece movement having a self-winding mechanism with at least one such oscillating weight, whose motions are transmitted to at least one mainspring comprised in said movement, characterized in that the movement includes at least one such device.

The invention further concerns a self-winding watch comprising a timepiece movement having a self-winding mechanism with at least one such oscillating weight, whose motions are transmitted to at least one mainspring comprised in said watch, characterized in that said watch includes at least one such device.

Thus, this invention provides a self-winding timepiece including a function display device whose mechanism is carried, wholly or partly depending on the variant, by the oscillating weight. The simplicity and compactness of the invention make it particularly advantageous to use. Excellent reliability is ensured and operation is guaranteed regardless of the level of wind of the mainspring. The information display is particularly legible, regardless of the position of the oscillating weight.

BRIEF DESCRIPTION OF THE DRAWINGS

Other features and advantages of the invention will appear upon reading the following detailed description, with reference to the annexed drawings, in which:

FIG. 15 is a schematic, exploded, perspective view of a self-winding movement carrying a display device according to FIGS. 1 to 5, of the oscillating weight provided with a moon phase disc and of a means of securing said weight to the movement.

FIG. 16 is a schematic cross-section through the pivot axis of a differential mechanism with a two planetary wheels and with no crown, as advantageously used in the invention.

FIG. 17 is a schematic cross-section through the pivot axis of the application of the mechanism of FIG. 16 to a display device according to the invention.

DETAILED DESCRIPTION OF PREFERRED EMBODIMENTS

Figure 1:
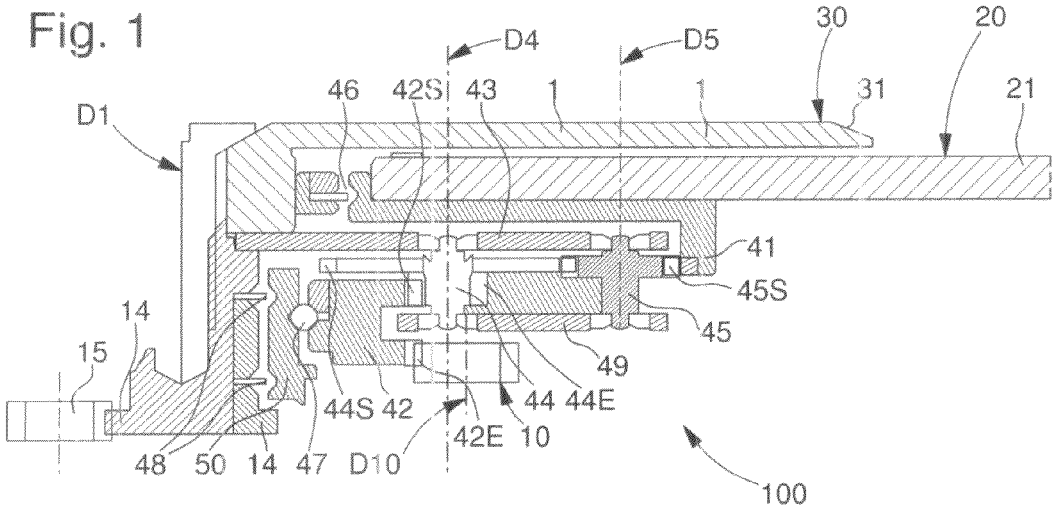
FIG. 1 is a schematic cross-section through the pivot axis of a display device on an oscillating weight according to the invention carrying an integrated "on-board" function indicator, which takes a reference across an output of the movement external to the oscillating weight.
Figure 2:
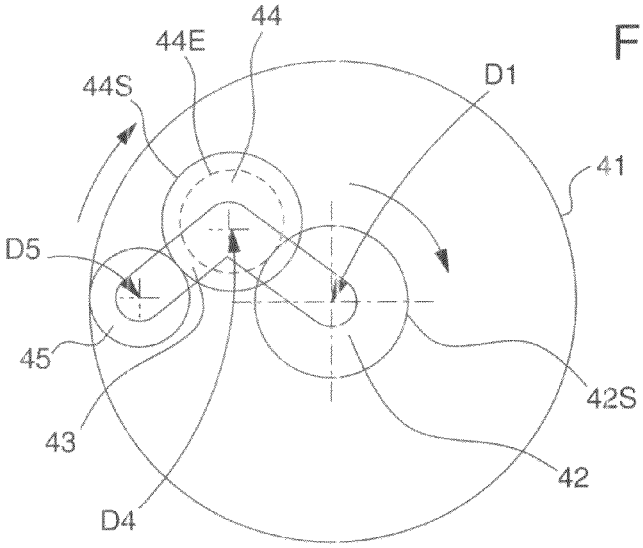
FIG. 2 is a schematic view of the mechanism of FIG. 1, seen from below.
Figure 3:
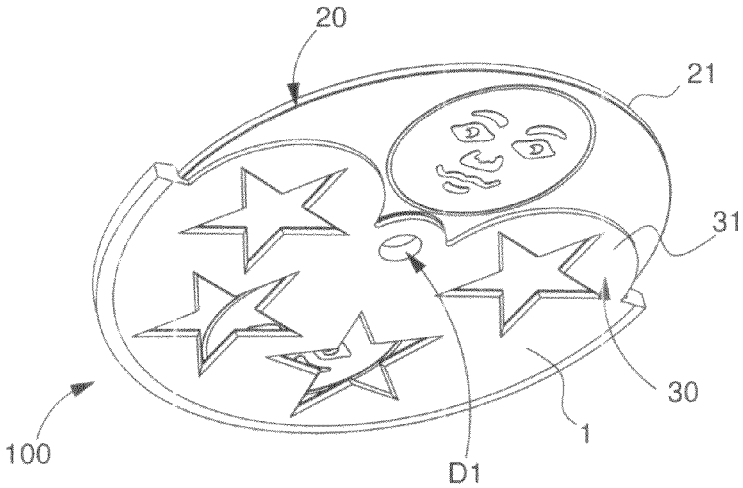
FIG. 3 is a perspective view of an oscillating weight according to FIGS. 1 and 2, carrying a moon phase display disc which is pivotally moveable relative to a complementary display integral with the oscillating weight.
Figure 4:
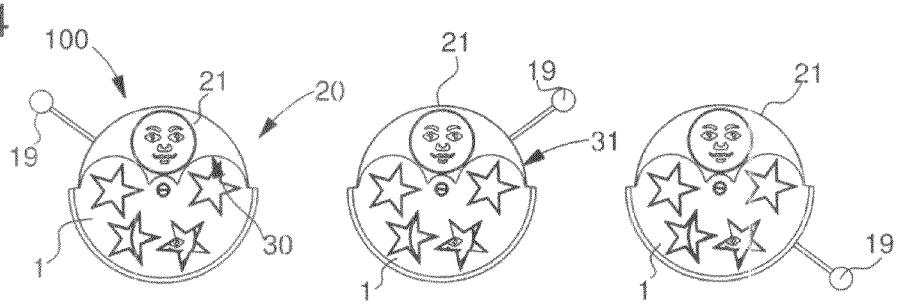
FIG. 4 shows a front view of three positions of the gravity powered oscillating weight of FIG. 3, and of the moon phase display which it carries, relative to the stem of the movement powered by said weight.
Figure 5:
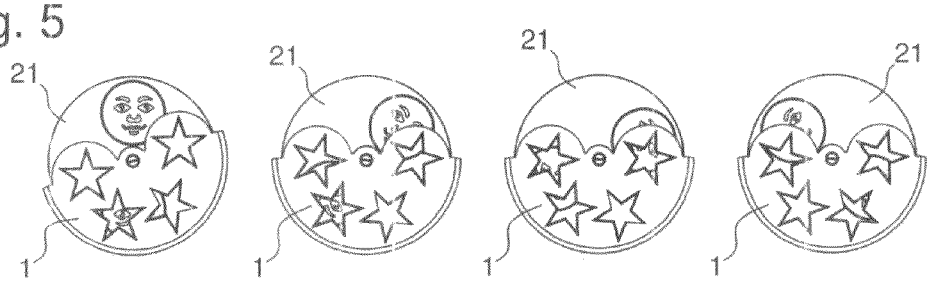
FIG. 5 shows a front view of four positions of the gravity powered oscillating weight of FIG. 3, and of the moon phase display which it carries, in succession over time.
Figure 6:
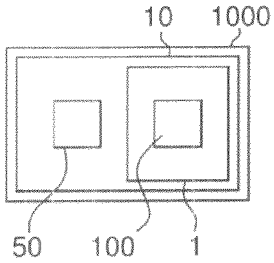
FIG. 6 shows, in the form of block diagrams, a timepiece with a self-winding movement comprising an oscillating weight and a display device according to the invention, moveable relative to a fixed part of the movement, the display device comprising at least one input cooperating with a particular functional output of said movement.

The invention concerns the field of self-winding watches with an oscillating weight. The invention proposes to provide a solution to the problem of integrating a display mechanism in the oscillating weight, which is reliable, simple to implement and robust.

An oscillating weight 1 oscillates in a pivoting motion about a pivot axis D1, generally, but not necessarily, located at the centre of the movement of a watch 1000 into which oscillating weight 1 is fitted. This watch 1000 comprises, in a conventional manner, at least one mainspring (not shown in the Figures) to which the motions of oscillating weight 1 are transmitted by a self-winding mechanism 15 incorporated in movement 10 of watch 1000, in order to wind said mainspring. The invention applies equally to an oscillating weight 1 located above or below movement 10 of watch 1000.

The invention concerns a device 100 for displaying at least one magnitude, entirely integrated in an oscillating weight 1 for self-winding movement 10, the display of said at least one magnitude being achieved on said oscillating weight 1.

This device 100 includes an oscillating weight 1 and a means 20 of displaying one or more magnitudes, by comparison to complementary display means 30. This complementary display means 30 is integrated in oscillating weight 1. Display means 20 may, in a non-limiting manner, be formed by a disc, or a hand or suchlike, whereas complementary display means 30 is formed, for example, by a dial, aperture, index, cover or suchlike. Display means 20 and complementary display means 30 are integrated in oscillating weight 1.

Oscillating weight 1 is powered by gravity; therefore the display of the magnitude or magnitudes must be able to move with the oscillating weight when the latter pivots under the effect of gravity.

According to the invention, display means 20 pivots coaxially to oscillating weight 1 about pivot axis D1.

At a given time, display means 20 is synchronous with oscillating weight 1. However, naturally, the display of the magnitude or magnitudes concerned changes over time, since display means 20 receives as many pieces of information as there are magnitudes to display from suitable outputs comprised for this purpose in movement 10. For the sake of simplicity, all of these outputs are uniformly designated by reference 10 for the movement in the drawings and in the following description.

In short, according to the invention, display means 20 is subject to a general pivoting motion resulting from the combination of a first pivoting motion synchronous with that of said oscillating weight 1, and a second pivoting motion resulting from display means 20 being pivoted by movement 10 relative to complementary display means 30 which is integral with oscillating weight 1.

Display means 20 is integrated in oscillating weight 1.

In a preferred embodiment, as seen in FIGS. 1 to 5, which show a variant relating to the display of a single magnitude, this display means 20 is integral with a crown 41 of a differential gear 40, whose stepped reference pinion 42 is driven by movement 10 via an input toothing 42E comprised in said reference pinion 42.

Advantageously, this differential gear 40 has two planetary wheels. A first planetary wheel, formed by a reducer wheel 44, pivoting about an axis D4, is driven via the input toothing 44E thereof by an output toothing 42S of reference pinion 42, and drives, via an output toothing 44S, a second planetary wheel 45, pivoting about an axis D5, and which in turn drives crown 41 via the toothing 45S thereof.

This differential gear 40 is arranged such that the instantaneous pivoting velocity of crown 41 is identical to the pivoting velocity of gravity powered oscillating weight 1, which carries planetary wheels 44; 45, and such that crown 41 and oscillating weight 1 pivot in the same direction.

The first planetary wheel 44 and the second planetary wheel 45 are carried by at least one planetary carrier arm 43, supplemented, if necessary, by a flange 49.

Depending upon the application selected, the display means may pivot, either in the same direction in which the oscillating weight pivots, or in the opposite direction to which the oscillating weight pivots. For the sake of simplicity, the Figures do not illustrate the insertion of any reverser pinions in the appropriate trains to ensure the proper pivoting direction.

FIG. 1 also shows a toothing 14 integral with oscillating weight 1, which meshes with a self-winding mechanism 15 known to those skilled in the art.

Complementary display means 30 is shown at the periphery of oscillating weight 1, particularly in the form of a contour 31. In the variants of FIGS. 7 to 11, means 30 takes the form of apertures 33, dials 32, or hands 12. FIG. 8 shows a variant with a cover 11, which may be transparent and used as a base for markings forming means 30. FIGS. 7 to 11 illustrate non-limiting examples of the application of the invention: a power reserve indicator in FIG. 7, a date mechanism in FIG. 8, a day disc in FIG. 9, a month disc in FIG. 10, and a time zone disc in FIG. 11.

Figure 7:
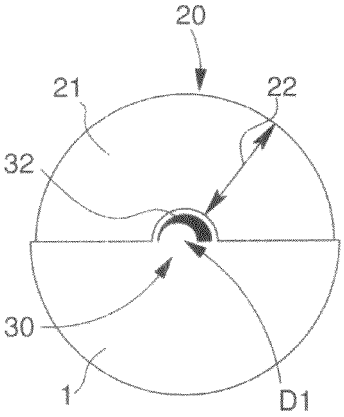
FIG. 7 is a schematic front view of an oscillating weight carrying a power reserve indicator moveable relative to a dial integral with the oscillating weight.
Figure 8:
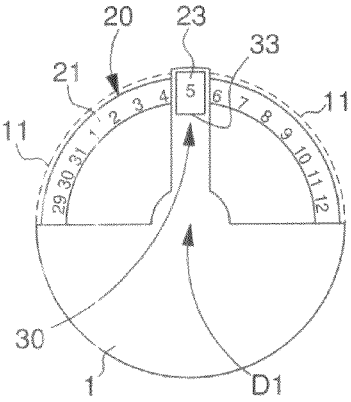
FIG. 8 is a schematic front view of an oscillating weight carrying a date disc moveable relative to an aperture integral with the oscillating weight.

In FIG. 7, display means 20 includes a power reserve indicator or hand 22, and complementary display means 30 includes a potential power reserve dial 32 arranged at the edge of oscillating weight 1.

Figure 9:
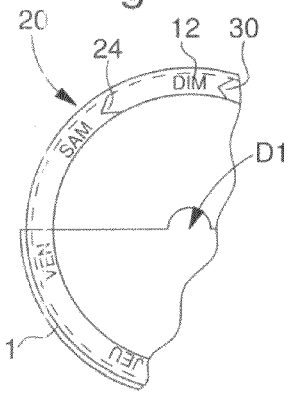
FIG. 9 is a schematic front view of an oscillating weight carrying a day disc moveable relative to an index integral with the oscillating weight.
Figure 10:
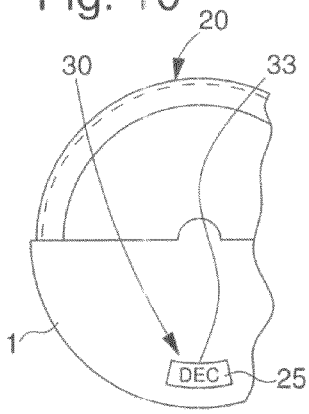
FIG. 10 is a schematic front view of an oscillating weight carrying a month disc moveable relative to an aperture integral with the oscillating weight.

In FIGS. 8 to 10, display means 20 includes a hand or a disc displaying the date 23 or day of the week 24 or month 25, and complementary display means 30 includes an aperture 33 arranged in oscillating weight 1 or a dial 12 integral with oscillating weight 1.

Figure 11:
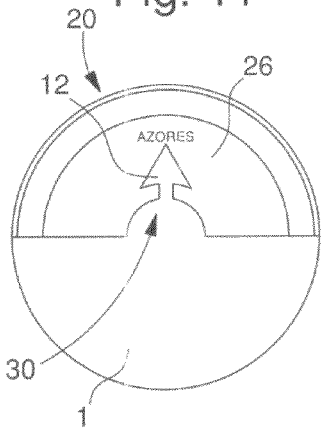
FIG. 11 is a schematic front view of an oscillating weight carrying a time zone disc moveable relative to an index integral with the oscillating weight.

In FIG. 11, display means 20 includes a time zone display disc or hand 26, and complementary display means 30 includes an aperture 33 arranged in oscillating weight 1 or a dial 12 integral with oscillating weight 1.

In a variant illustrated in FIGS. 1 to 5, differential gear 40 is carried by oscillating weight 1.

For a good synchronous display with the motion of the oscillating weight, FIG. 16 shows the principle of a differential mechanism with two planetary wheels and no crown, which is particularly suitable. The architecture of FIG. 17 shows therefore a variant wherein differential gear 40 is housed in movement 10 and is external to oscillating weight 1.

In the variant illustrated in FIGS. 1 to 5, reference pinion 42 pivots about a fixed part 50 or a bridge of movement 10 via at least one ball bearing 48 or a similar pivotal guide member.

In this same variant illustrated in FIGS. 1 to 5, oscillating weight 1 pivots about a fixed part 50 or a bridge of movement 10 via at least one ball bearing 4 or a similar pivotal guide member.

Advantageously, these bearings 47 and 48 may be combined, as seen in FIG. 1, so that the outer ring of bearing 48 also forms the inner ring of bearing 47.

In the variant illustrated in FIGS. 1 to 5, display means 20 pivots about oscillating weight 1 via at least one ball bearing 46 or a similar pivotal guide member.

In another variant, illustrated in FIG. 17, display means 20 pivots coaxially to oscillating weight 1 and independently therefrom, about a guide element 51, such as a sleeve or suchlike, via at least one ball bearing 52 or a similar pivotal guide member.

Figure 12:
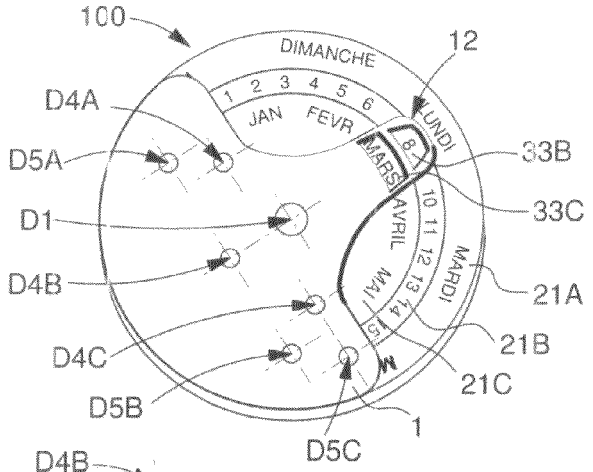
FIG. 12 is a schematic perspective view of a display device on an oscillating weight according to the invention, combining three displays of the day, date and month, via the same number of coaxial discs which are moveable relative to apertures and indices integral with the oscillating weight.
Figure 13:
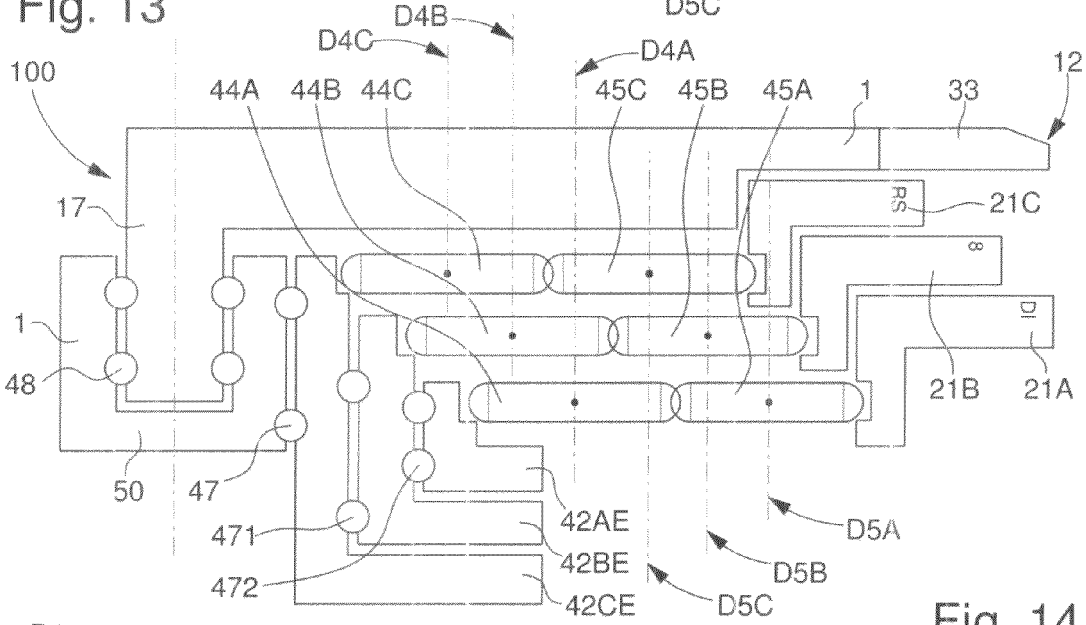
FIG. 13 shows a schematic cross-section through the pivot axis of the device of FIG. 12.
Figure 14:
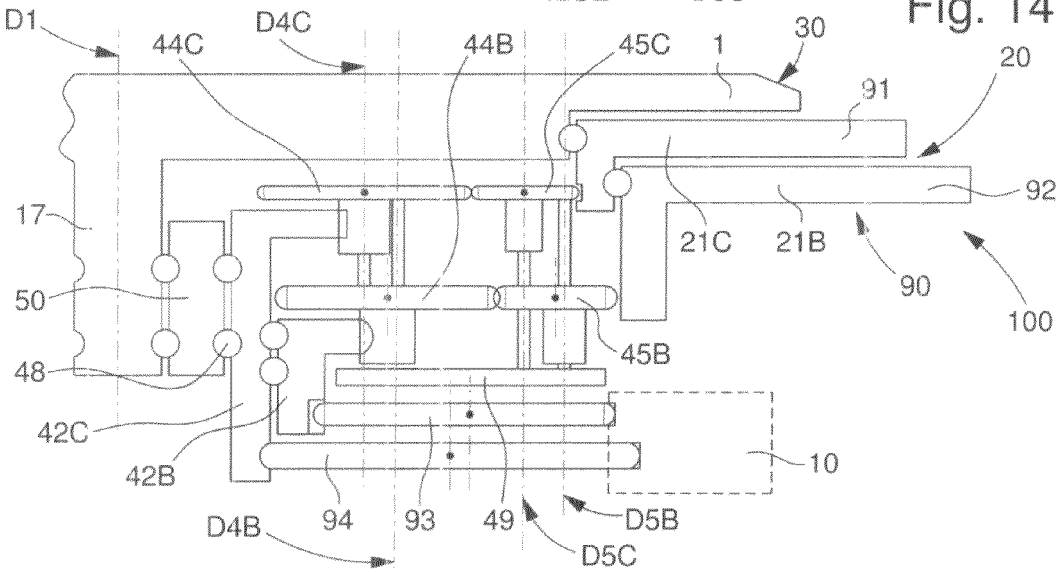
FIG. 14 is a similar view to FIG. 13 of a device combining two displays, of the date and month, via the same number of coaxial discs which are moveable relative to apertures and indices integral with the oscillating weight, in a different arrangement from that of FIG. 13.

In the case of FIGS. 12 to 14, display means 20 includes several elementary displays each for a particular function, which each cooperate with a complementary elementary display comprised in complementary display means 30.

FIGS. 12 to 14 thus illustrate the combination of several displays on the same oscillating weight 1: FIG. 12 combines three displays, of the day, date and month, via the same number of discs 21A, 21B, 21C, which are coaxial and moveable relative to apertures 33B, 33C and index 12 integral with oscillating weight 1. Three concentric cannon-pinions comprise input wheels 42AE, 42BE, 42CE, which extract information from the outputs (not shown) of the movement. They are guided on each other by guide members or bearings 471 and 472, the innermost is guided by a guide member or a bearing 47 on a fixed part 50 of movement 10, which also carries guide member 48 of an arbour 17 comprised in oscillating weight 1. The three cannon-pinions mesh with wheels 44A, 44B, 44C, of axes D4A, D4B, D4C. These wheels mesh with intermediate wheels 45A, 45B, 45C of axes D5A, D5B, D5C, and said intermediate wheels in turn drive crowns 21A, 21B, 21C.

FIG. 14 illustrates a similar device combining two displays, of the date and month, via two discs which are coaxial and moveable relative to apertures and indices integral with the oscillating weight, in a different arrangement from that of FIG. 13, since it is pinions 42B and 42C of the cannon-pinions which mesh with date information input 93 and month information input 94, meshed on the appropriate output of movement 10.

The invention also concerns an oscillating weight 1 for a self-winding watch, including at least one display indicator device 100 of this type.

As seen in FIG. 15, with display means 20 and the associated drive means, oscillating weight 1 advantageously forms a pre-assembled module ready to be secured to a self-winding mechanism 15 of a timepiece 1000.

The invention also concerns a timepiece movement 10 having a self-winding mechanism with at least one oscillating weight 1 of this type, whose motions are transmitted to at least one mainspring comprised in movement 10, and at least one device 100 of this type.

The invention also concerns a self-winding watch 1000 comprising a timepiece movement 10 having a self-winding mechanism with at least one oscillating weight 1 of this type, whose motions are transmitted to at least one mainspring comprised in said watch 1000, and comprising at least one device 100 of this type.

It goes without saying that this invention is not limited to the embodiment that has just been described and that various simple alterations and variants can be envisaged by those skilled in the art without departing from the scope of the invention as defined by the annexed claims. In particular, it is possible to envisage inserting intermediate wheels so that the gear ratios are equal and of opposite signs, and the ratio between the various gears of the differential display mechanism are kept at 1.

What is claimed is:

1. A device for displaying at least one magnitude on an oscillating weight for a self-winding timepiece movement, said device comprising one said oscillating weight and a means of displaying said at least one magnitude by comparison to a complementary display means which is integral with said oscillating weight, wherein said display means pivots coaxially to said oscillating weight, wherein said display means is subject to a general pivoting motion resulting from the combination of a first pivoting motion synchronous with that of said oscillating weight, and a second pivoting motion resulting from said display means being pivoted by said movement relative to said complementary display means.

2. The device according to claim 1, wherein said display means is integrated in said oscillating weight.

3. The device according to claim 1, wherein said display means is integral with a crown of a differential gear whose reference pinion is driven by said movement.

4. The device according to claim 3, wherein said differential gear is a differential gear with two planetary wheels, of which a first planetary wheel is driven by said reference pinion and drives a second planetary wheel which in turns drives said crown.

5. The device according to claim 4, wherein said differential gear is arranged so that the pivoting velocity of said crown is identical to the pivoting velocity of said oscillating weight carrying said planetary wheels, and so that said crown and said oscillating weight pivot in the same direction.

6. The device according to claim 3, wherein said reference pinion comprises an input toothing driven by said movement and an output toothing driving said first planetary wheel.

7. The device according to claim 3, wherein said differential gear is carried by said oscillating weight.

8. The device according to claim 3, wherein said differential gear is housed in said movement and is external to said oscillating weight.

9. The device according to claim 3, wherein said reference pinion pivots about a fixed part or a bridge of said movement via at least one ball bearing.

10. The device according to claim 1, wherein said oscillating weight pivots about a fixed part or a bridge of said movement via at least one ball bearing.

11. The device according to claim 1, wherein said display means pivots about said oscillating weight via at least one ball bearing.

12. The device according to claim 1, wherein said display means pivots coaxially to said oscillating weight and independently therefrom.

13. The device according to claim 1, wherein said display means includes several elementary displays each for a particular function, which each cooperate with a complementary elementary display comprised in said complementary display means.

14. The device according to claim 1, wherein said display means includes a moon phase display disc, and wherein said complementary display means includes a complementary moon phase display contour arranged at the edge of said oscillating weight.

15. The device according to claim 1, wherein said display means includes a power reserve indicator or hand, and wherein said complementary display means includes a potential power reserve dial arranged at the edge of said oscillating weight.

16. The device according to claim 1, wherein said display means includes a disc or hand displaying the date or day of the week or month, and wherein said complementary display means includes an aperture arranged in said oscillating weight or a dial integral with said oscillating weight.

17. The device according to claim 1, wherein said display means includes a time zone display hand or disc, and wherein said complementary display means includes an aperture arranged in said oscillating weight or a dial integral with said oscillating weight.

18. The device according to claim 1, wherein, with said display means and associated drive means, the device forms a pre-assembled module ready to be secured to a self-winding mechanism for a timepiece.

19. A timepiece movement having a self-winding mechanism with at least one oscillating weight whose motions are transmitted to at least one mainspring comprised in said movement, wherein said movement includes at least one said device according to claim 1.

20. A self-winding watch comprising a timepiece movement having a self-winding mechanism with at least one oscillating weight, whose motions are transmitted to at least one mainspring comprised in said watch, and wherein said watch includes at least one said device according to claim 1.

* * * * *